US006609928B1

(12) United States Patent
Le

(10) Patent No.: US 6,609,928 B1
(45) Date of Patent: Aug. 26, 2003

(54) STACK UNIVERSAL SERIAL BUS CONNECTOR

(75) Inventor: Chanh Le, Tigard, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/596,032

(22) Filed: Jun. 15, 2000

Related U.S. Application Data

(62) Division of application No. 08/663,648, filed on Jun. 14, 1996.

(51) Int. Cl.[7] ..... H01R 13/648
(52) U.S. Cl. ..... 439/541.5; 439/607; 439/939
(58) Field of Search ..... 439/79, 607, 939, 439/541.5, 608–610

(56) References Cited

U.S. PATENT DOCUMENTS

| | | | |
|---|---|---|---|
| 4,659,163 | A | 4/1987 | Althous et al. |
| 5,030,115 | A | 7/1991 | Regnier et al. |
| 5,037,330 | A | 8/1991 | Fulponi et al. |
| 5,178,562 | A | 1/1993 | Ermini |
| 5,255,146 | A | 10/1993 | Miller |
| 5,400,202 | A | 3/1995 | Metz et al. |
| 5,562,507 | A | 10/1996 | Kan |

*Primary Examiner*—Gary Paumen
(74) *Attorney, Agent, or Firm*—Blakely, Sokoloff, Taylor & Zafman

(57) ABSTRACT

A stacked dual socket system that is interchangeable with and has no larger footprint than a single USB compliant socket and which allows connector access to both USB channels. The stacked socket includes a first USB compliant socket and a second USB compliant socket. The second USB compliant socket is stacked on top of the first socket relative to the mother board so that the stacked has the same footprint on the mother board as a single USB compliant socket. Each socket has a linear array of four conductor pins that project downwardly from the bottom of the first socket within the footprint of the socket and makes contact with two separate arrays of electrical conductors in the mother board. The bottom of the first socket has four spaced apart legs that form the mechanical interface between the stacked socket and the mother board and which provide improved mechanical stability. An electrically conductive cowling encases all sides of both sockets except for the bottom and the front. A bridge section of the cowling passes across the front surface of the stacked socket from one side to the other between the openings into the two sockets. The section of the cowling has one or more finger elements that protrude outwardly from the front surface and make contact with the chassis into which the mother board is assembled. This provides electromagnetic radiation shielding.

9 Claims, 3 Drawing Sheets

STACK UNIVERSAL SERIAL BUS CONNECTOR

CROSS-REFERENCES TO RELATED APPLICATIONS

This is a divisional of a U.S. patent application (application Ser. No. 08/663,648) filed Jun. 14, 1996.

BACKGROUND OF THE INVENTION

1. Field of the Invention

The present invention relates to a connector for the universal serial bus ("USB"). More particularly, it relates to a stacked dual connector system that is interchangeable with and has no larger footprint than a single USB compliant connector.

2. Description of the Prior Art

A new standard for a serial communications architecture called the universal serial bus ("USB") has been completed and is now in use in personal computers and elsewhere. The USB architecture is fast and allows daisy chaining up to 127 devices. The USB standard defines two channels: a fast channel running at 500 mega-bits/second which will be used for monitors, networks, and printers; and a slow channel running at 100 kilo-bits/second which will be used for keyboards, the mice, scanners and modems. USB controllers are designed to handle both channels.

A perspective view of the currently available USB compliant connector is set out in FIG. 1. Referring now to FIG. 1, a single USB compliant socket consists of a rectangular shaped housing 12 having a front surface 14, side surfaces 16 and 18, a top surface 20, a back surface 22 and a bottom surface 24. Bottom surface 24 sits on a mother board 26 and occupies an area of mother board 26 which is shown in FIG. 1 as striped area 28. This area is called the footprint of housing 12. An opening 30 in front surface 14 leads to a cavity within housing 12. Within this cavity there are four conductors (not shown) which are connected internally to four pins (not shown) that project downwardly through bottom 24 and make contact with four conductors (not shown) on mother board 26. An electrically conducting cowling (not shown) fits around the outside of housing 12 and is connected to the chassis of the computer (not shown) to provide shielding against electromagnetic radiation. A USB compliant plug fits through opening 30 into the cavity and makes electrical contact with the four conductors. Together the socket and plug form a USB compliant connector that is used to electrically connect peripheral devices to the mother board on which the CPU of the computer is located. The mechanical dimensions and tolerances as well as the electrical specifications for both the socket and the plug are well known and are not part of this invention.

The problem with the single USB connector is that it can handle only one of the two USB channels. Thus, if a computer system for example is to have both the slow channel and the fast channel, there must be two separate USB connectors on the mother board. However, the arrangement of the mother board in the computer chassis does not provide enough room for two side by side USB connectors.

SUMMARY OF THE INVENTION

The invention is an improvement on a single USB compliant socket for mounting on a predetermined area of a mother board and includes a first USB compliant socket having a first array of conductors that make electrical contact with a mating array of electrical conductors in a USB compliant plug and which make contact with a mating first array of electrical conductors on the mother board. The mother board is situated within a computer chassis. The invention includes a second USB compliant socket assembly having a second array of conductors that make electrical contact with a mating array of conductors in a USB compliant plug. The second USB compliant socket assembly is positioned adjacent to the first USB compliant socket assembly such that the first and second USB compliant socket assemblies together occupy an area on the mother board that is no greater than the area on the mother board occupied by a single connector. The second array of conductors makes contact with a second linear array of conductors on the mother board.

BRIEF DESCRIPTION OF THE DRAWING

The preferred embodiment of the invention will now be described in connection with the Drawing in which.

DESCRIPTION OF THE PREFERRED EMBODIMENT

Figure 1:
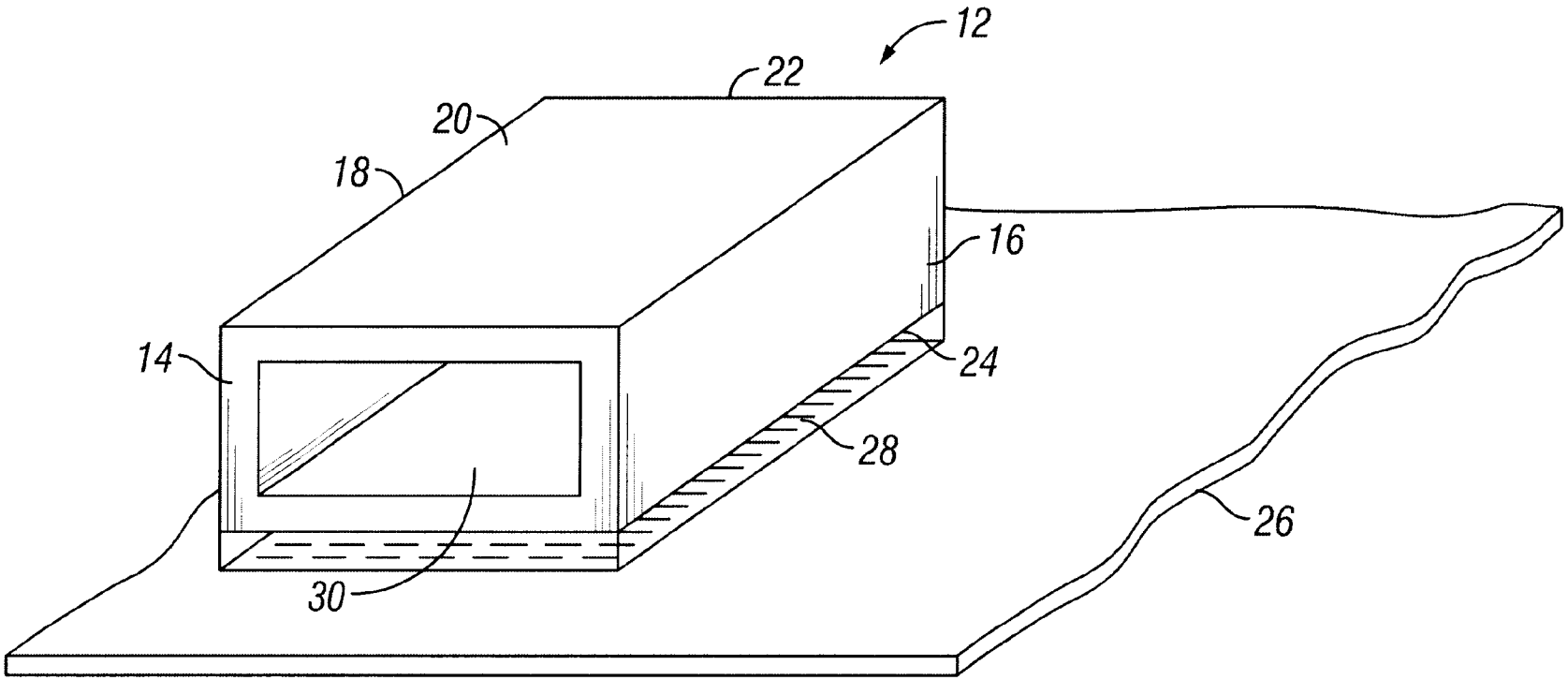
FIG. 1 (Prior Art)
FIG. 1 is a perspective view of the currently available USB compliant connector
Figure 2:
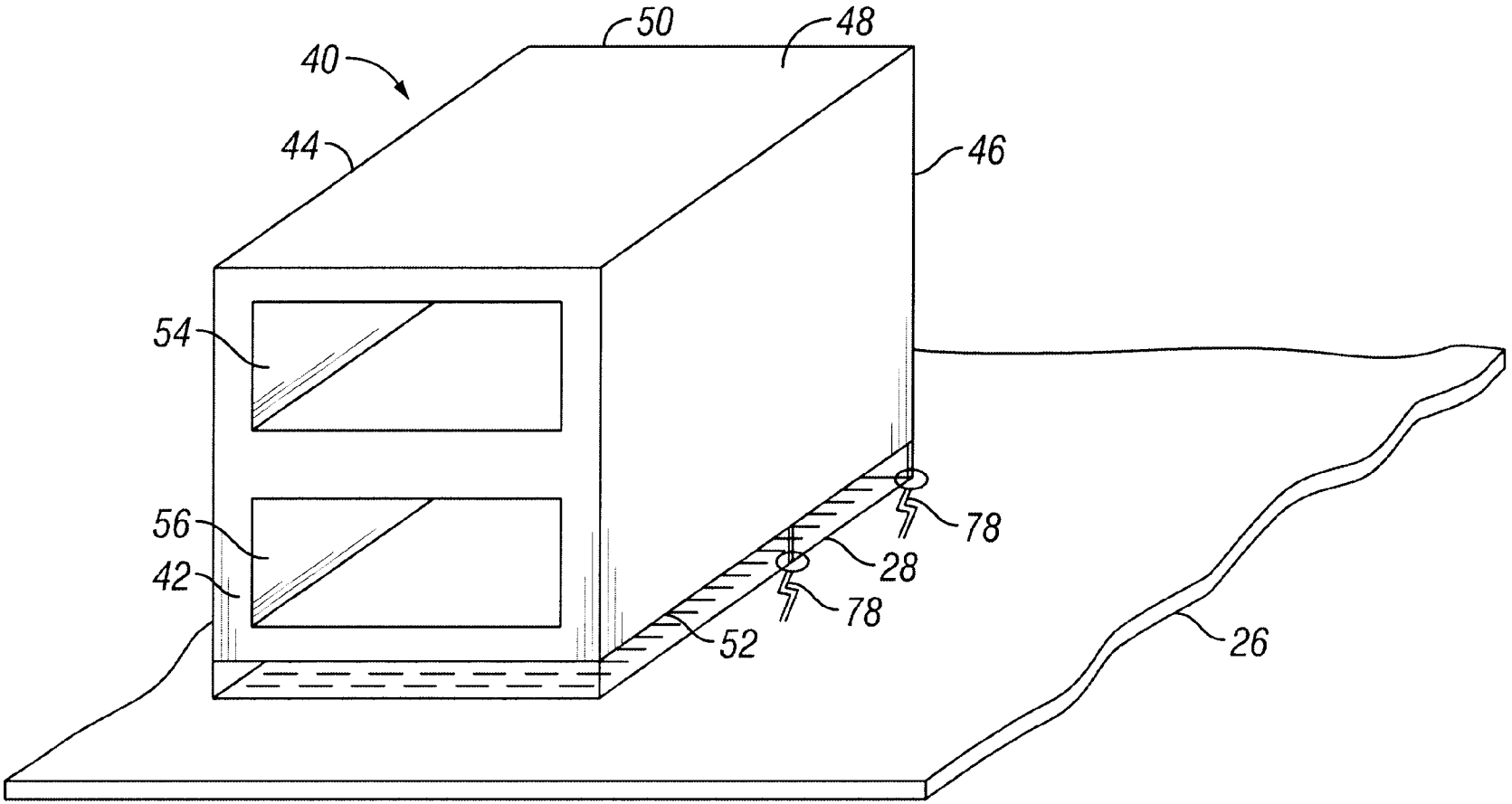
FIG. 2 is a perspective view of a stacked USB connector on a mother board according to the present invention.

FIG. 2 is a perspective view of a stacked USB socket on a mother board. Referring now to FIG. 2, a stacked USB compliant socket system consists of a rectangular shaped housing 40 having a front surface 42, side surfaces 44 and 46, a top surface 48, a back surface 50 and a bottom surface 52. Bottom surface 52 occupies an area 28, called a footprint, of mother board 26. Footprint 28 is substantially the same area as that occupied by a single, prior art USB compliant socket. Thus, the addition of a second socket takes up no additional mother board area. As a result, the dual stacked USB socket system allows connector access to both USB channels and is interchangeable with and has no larger footprint than a single USB compliant socket. Front surface 42 has an upper opening 54 and a lower opening 56 which provide access to an upper cavity 58 and a lower cavity 60 within housing 40.

Figure 3:
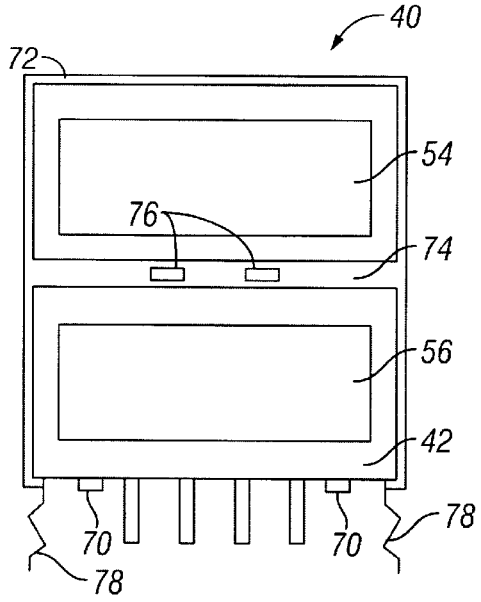
FIG. 3 is a front view of a stacked USB connector according to the present invention.
Figure 4:
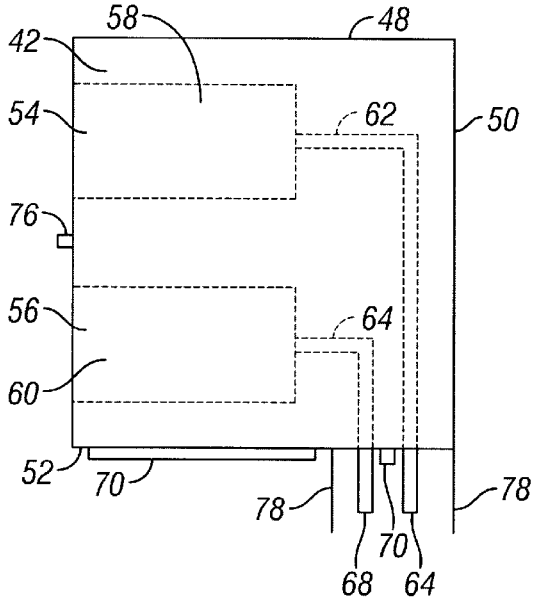
FIG. 4 is a side view of a stacked USB connector according to the present invention.
Figure 5:
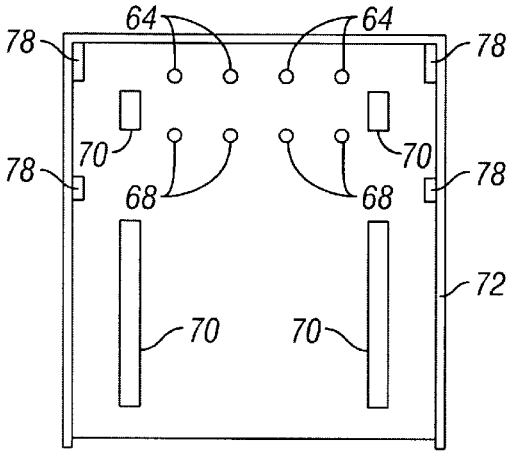
FIG. 5 is a bottom view of a stacked USB connector according to the present invention.

FIG. 3, FIG. 4 and FIG. 5 are front, side and bottom views the present invention. Referring now to FIGS. 3, 4, and 5 together, within upper cavity 58 there are four conductors 62 which are connected to four pins 64 that project downwardly through bottom 52 and make contact with an array of four conductors (not shown) on mother board 26. Likewise, within lower cavity 60 there are four conductors 66 connected to four pins 68 which also penetrate lower surface 52 to make contact with an independent array of four conductors (not shown) on mother board 26. Pin arrays 64 and 68 are each linear arrays and both linear arrays fall within footprint 28. Both upper cavity 58 and lower cavity 60 along with the structural elements of housing 40 that form them and the electrical components associated with them form two USB compliant sockets. USB compliant plugs fits through openings 54 and 56 into cavities 58 and 60 and make electrical contact with the conductors. Together the sockets and plugs form a stacked USB compliant connector.

Again, the mechanical dimensions and tolerances as well as the electrical specifications for both the socket and the plug are well known and are not part of this invention.

In the preferred embodiment, housing 40 is unitary, and is made by injection molding of a high dielectric organic material.

Four legs 70 extend downwardly from bottom surface 52 a short distance (as best seen in FIG. 5) and make contact with the top surface of mother board 26. Legs 70 are the mechanical interface between housing 40 and mother board 26. In the single USB compliant connector, there were only two legs. The addition of two more legs provides added mechanical stability.

An electrically continuous conducting cowling 72 wraps around sides 44 and 46 back 50 and top surfaces 48 completely. Cowling 72 also includes a bridge element 74 which passes across front surface 42 between upper opening 54 and lower opening 56. Cowling 72 provides electrical shielding of the entire stacked socket to minimize any electromagnetic radiation that may be emitted from the connectors. Bridge element 74 has two fingers 76 which extend outwardly from the bridge element. Fingers 76 are designed to make electrical contact with the computer chassis in which mother board 26 is mounted. In this way, cowling 72 is grounded to the chassis of the computer.

Clips 78 are extensions of cowling 72 that project downwardly beyond the plane of bottom surface 52. There are four spaced apart clips located as shown best in FIG. 5. Each clip is designed to pass through a mating hole in mother board 26 when the stacked socket assembly is mounted on the mother board. As best shown in FIG. 3, clips 78 have four bends which cause clips 78 not to fit through the mating holes in the mother board without deforming. The clips do deform as they are passed through the holes, but spring back to their original shape once through the hole and thereby lock cowling 72 and thus housing 40 securely to mother board 26.

The foregoing preferred embodiments are subject to numerous adaptations and modifications without departing from the concept of the invention. Therefore, within the scope of the appended claims, the invention may be practiced other than as specifically described.

What is claimed is:

1. A method for providing multiple Universal Serial Bus (USB) sockets having different transfer rates, the method comprising:

a) arranging at least two USB sockets in a stacked position while providing concurrent USB communication channels at different USB transfer rates, wherein said at least two USB sockets are formed within an integral housing comprising:

a bridge separating said USB sockets wherein said bridge includes a pair of conducting fingers for attachment to a computer chassis;

an EMI shielding cowling wrapped around a plurality of sides and a top surface and a back surface of said integral housing and including said bridge, such that both the EMI shielding cowling and the bridge are electrically coupled to the computer chassis;

at least four legs; and at least two clips;

b) attaching the arrangement to a substrate such that the at least four legs makes contact with said substrate and the at least two clips extend through respective openings in said substrate;

c) electrically connecting USB socket conductors to the substrate;

d) transmitting data through one of said two USB sockets at a data rate of 500 mega-bits per second; and e) transmitting data through the other of said two USB sockets at a data rate of 100 kilo-bits per second.

2. The method as recited in claim 1, wherein the substrate is a motherboard.

3. The method as recited in claim 1, wherein arranging the at least two USB sockets in a stacked position is performed by forming the sockets within the same housing.

4. The method as recited in claim 1, wherein attaching the stacked USB sockets to the substrate is performed by employing a plurality of extensions of the cowling that extend downwardly, beyond the plane of the bottom surface, and fit through mating holes in the substrate.

5. A method for constructing and using a Universal Serial Bus (USB) connector housing, the method comprising:

a) forming a plurality of USB compliant sockets to concurrently support at least a fast USB channel and a slow USB channel, the fast USB channel and the slow USB channel having substantially different data rates, each of the plurality of USB compliant sockets having a front surface, a back surface, a bottom surface, and a top surface, wherein said plurality of USB sockets are formed within an integral housing comprising:

a bridge separating said USB sockets wherein said bridge includes a pair of conducting fingers for attachment to a computer chassis;

an EMI shielding cowling wrapped around a plurality of sides and a top surface and a back surface of said integral housing and including said bridge, such that both the EMI shielding cowling and the bridge are electrically coupled to the computer chassis;

b) arranging a plurality of electrically conductive elements within each of the sockets which protrude through the bottom surface of the connector;

c) transmitting data through one of said two USB sockets at a data rate of 500 mega-bits per second; and d) transmitting data through the other of said two USB sockets at a data rate of 100 kilo-bits per second.

6. The method as recited in claim 5, further comprising adding a first side surface and a second side surface to the housing.

7. The method as recited in claim 5, further comprising attaching a plurality of fingers extending outwardly from the bridge element at the front surface to provide a ground for the cowling.

8. The method as recited in claim 5, wherein forming a plurality of USB compliant sockets further includes:

arranging the plurality of USB compliant sockets in a stacked configuration such that the stacked configuration fits in a footprint similar in size to a single USB compliant socket configuration, while providing concurrent USB communication channels to receive and transfer data at different USB transfer rates.

9. A method for providing multiple Universal Serial Bus (USB) sockets having different transfer rates, the method comprising:

a) arranging at least two USB sockets in a stacked position to concurrently support a fast USB channel and a slow USB channel, one of the at least two USB ports supporting the slow USB channel and another of the at least two USB ports supporting the fast USB channel, the fast USB channel having a substantially different data rate than the slow USB channel, wherein said at least two USB sockets are formed within an integral housing comprising:

a bridge separating said USB sockets wherein said bridge includes a pair of conducting fingers for attachment to a computer chassis;

an EMI shielding cowling wrapped around a plurality of sides and a top surface and a back surface of said integral housing including said bridge, such that both the EMI shielding cowling and the bridge are electrically coupled to the computer chassis;

at least four legs; and at least two clips;

b) attaching the at least two USB sockets to a substrate such that the at least four legs makes contact with said substrate and the at least two clips extend through respective openings in said substrate;

c) transmitting data through one of said two USB sockets at a data rate of 500 mega-bits per second; and d) transmitting data through the other of said two USB sockets at a data rate of 100 kilo-bits per second.

* * * * *